US008701318B2

(12) United States Patent
Kim

(10) Patent No.: US 8,701,318 B2
(45) Date of Patent: Apr. 22, 2014

(54) ANGLE ADJUSTMENT APPARATUS OF IMAGE DISPLAY MODULE

(75) Inventor: Yong Min Kim, Jeonju-si (KR)

(73) Assignee: Everbrighten Co., Ltd. (KR)

( * ) Notice: Subject to any disclaimer, the term of this patent is extended or adjusted under 35 U.S.C. 154(b) by 5 days.

(21) Appl. No.: 13/606,207

(22) Filed: Sep. 7, 2012

(65) Prior Publication Data

US 2013/0175913 A1 Jul. 11, 2013

(30) Foreign Application Priority Data

Jan. 9, 2012 (KR) ..... 10-2012-0002613

(51) Int. Cl.
*G09F 13/20* (2006.01)

(52) U.S. Cl.
USPC ..... 40/493; 349/58; 29/426.5; 248/456

(58) Field of Classification Search
USPC ..... 248/581; 29/426.5; 349/58–65; 40/755–758, 493
See application file for complete search history.

(56) References Cited

U.S. PATENT DOCUMENTS 4,261,122 A * 4/1981 LeVine ..... 40/711
5,050,324 A * 9/1991 Casull ..... 40/767
5,268,816 A * 12/1993 Abell et al. ..... 361/679.09
5,486,942 A * 1/1996 Ichikawa et al. ..... 349/58
6,144,423 A * 11/2000 Kim ..... 349/58
6,154,945 A 12/2000 Voelzke
6,487,802 B2 * 12/2002 Suen ..... 40/542
7,836,623 B2 * 11/2010 Wang et al. ..... 40/747
7,987,622 B2 * 8/2011 Pitt et al. ..... 40/603
8,319,911 B2 * 11/2012 Dai ..... 349/58
8,432,507 B2 * 4/2013 Dai ..... 349/58
2003/0189681 A1 * 10/2003 Han et al. ..... 349/58
2009/0031846 A1 * 2/2009 Dal Pra' et al. ..... 74/502.2
2012/0159823 A1 * 6/2012 Gibb et al. ..... 40/606.01

* cited by examiner

*Primary Examiner* — Shin Kim
(74) *Attorney, Agent, or Firm* — Cantor Colburn LLP

(57) ABSTRACT

An angle adjustment apparatus of an image display module includes a display panel configured to have image display devices arranged and disposed therein; fixture frames disposed on the upper and lower sides of the display panel, respectively; rotation frames disposed on one side and the other side of the display panel, respectively; and step angle adjustment units disposed between the auxiliary frames of the display panel and the rotation frames and configured to adjust an angle of the rotation frames by stepwise moving the rotation frames at a constant angle when the rotation frames are rotated. The angle adjustment apparatus can reduce the time taken to install and dismantle image display modules because the angle adjustment work of an image display module is easy and can adjust the angle of the image display module precisely by moving the image display modules at a constant angle stepwise.

13 Claims, 6 Drawing Sheets

ANGLE ADJUSTMENT APPARATUS OF IMAGE DISPLAY MODULE

CROSS REFERENCE TO RELATED APPLICATION

This application claims the benefit of Korean Patent Application No. 10-2012-0002613, filed Jan. 9, 2012, which is hereby incorporated by reference in its entirety into this application.

BACKGROUND OF THE INVENTION

1. Technical Field

The present invention relates to the angle adjustment apparatus of an image display module and, more particularly, to the angle adjustment apparatus of an image display module which can perform the angle adjustment work of an image display module.

2. Description of the Related Art

An electric bulletin board is used as an image display devices for displaying advertisements or images, and a plurality of image display modules is arranged in a matrix form in the electric bulletin board. Light-Emitting Diodes (LEDs) are used as the image display modules in order to represent a variety of colors or reduce power consumption. Each of the LEDs is used to display information about the pixel of an image signal.

The image display module used in an electric bulletin board using LEDs. The image display module described in the prior art document includes outer frames, a center frame, an LED board, and connection members. The outer frames have a quadrangle. The center frame is formed at the center of the outer frames and configured to form a space so that a control unit is included in the space. The center frame includes a cover for covering the rear. Both ends of the LED board are combined with the front of the outer frames and the center frame, and the connection members consecutively couple the outer frames up, down, left, and right so that the image display modules are fixed according to the size of the electric bulletin board or is easily disassembled.

An angle between adjacent image display modules has to be controlled by taking a viewing angle or the characteristics of installation structures into consideration. The electric bulletin board includes an angle adjustment apparatus for controlling an angle between the image display modules. In the conventional angle adjustment apparatus, after an angle between the image display modules is controlled, the image display modules are fixed or separated using fastening members, such as screws or nuts.

SUMMARY OF THE INVENTION

A conventional angle adjustment apparatus is problematic in that the time taken for the angle adjustment work of an image display module is long because fastening members, such as screws or nuts, are used and thus the time taken to fix or dismantle the fastening members disposed between lots of image display modules is necessary in a process of installing or dismantling an electric bulletin board.

An object of the present invention is to provide the angle adjustment apparatus of an image display module which is capable of performing the angle adjustment work of an image display module rapidly and easily.

Another object of the present invention is to provide the angle adjustment apparatus of an image display module which is capable of adjusting the angle of an image display module precisely by stepwise moving the image display modules at a constant angle and then rotating the image display modules.

The angle adjustment apparatus of an image display module according to the present invention includes a display panel configured to have the image display devices arranged and disposed therein; fixture frames disposed on the upper and lower sides of the display panel, respectively; rotation frames disposed on one side and the other side of the display panel, respectively; and step angle adjustment units disposed between the auxiliary frames of the display panel and the rotation frames and configured to adjust an angle of the rotation frames by stepwise moving the rotation frames at a constant angle when the rotation frames are rotated.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
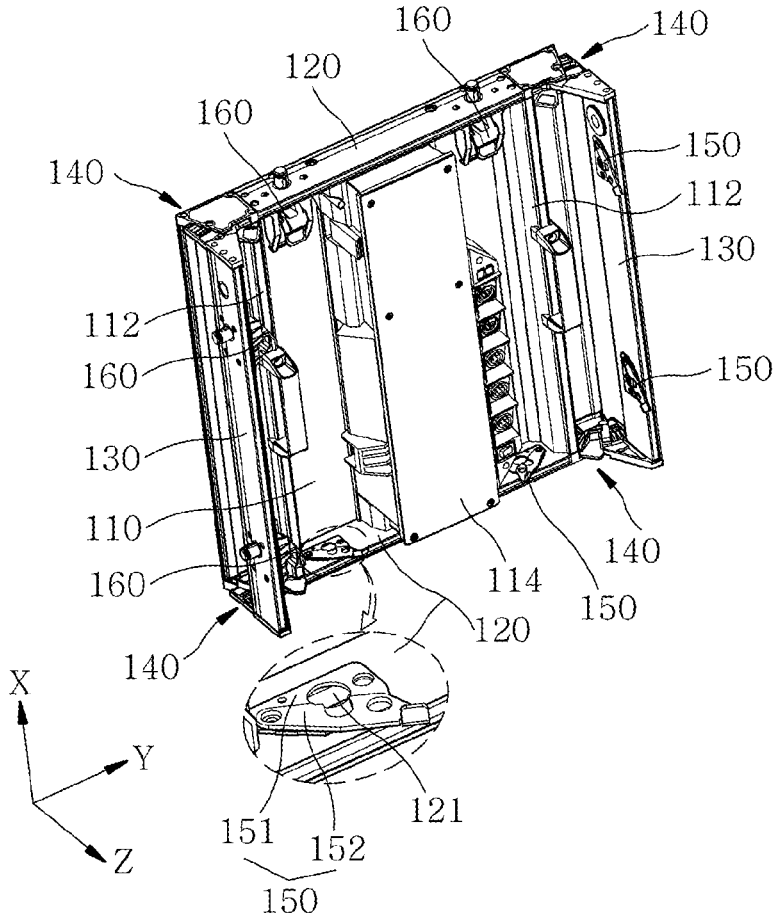
FIG. 1 is a perspective view of the angle adjustment apparatus of an image display module according to the present invention.

Reference now should be made to the drawings, in which the same reference numerals are used throughout the different drawings to designate the same or similar components.

Figure 2:
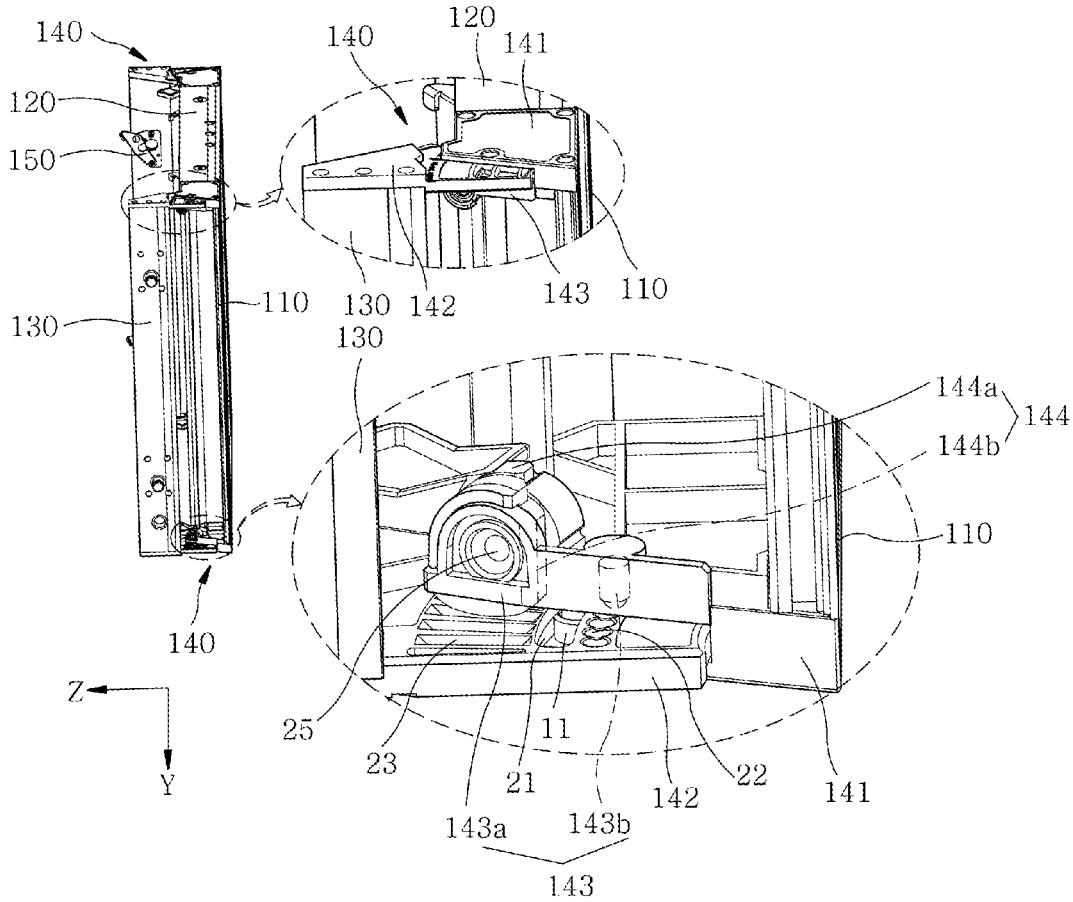
FIG. 2 is a perspective view of the angle adjustment apparatus of an image display module shown in FIG. 1 which is view from another direction.
Figure 3:
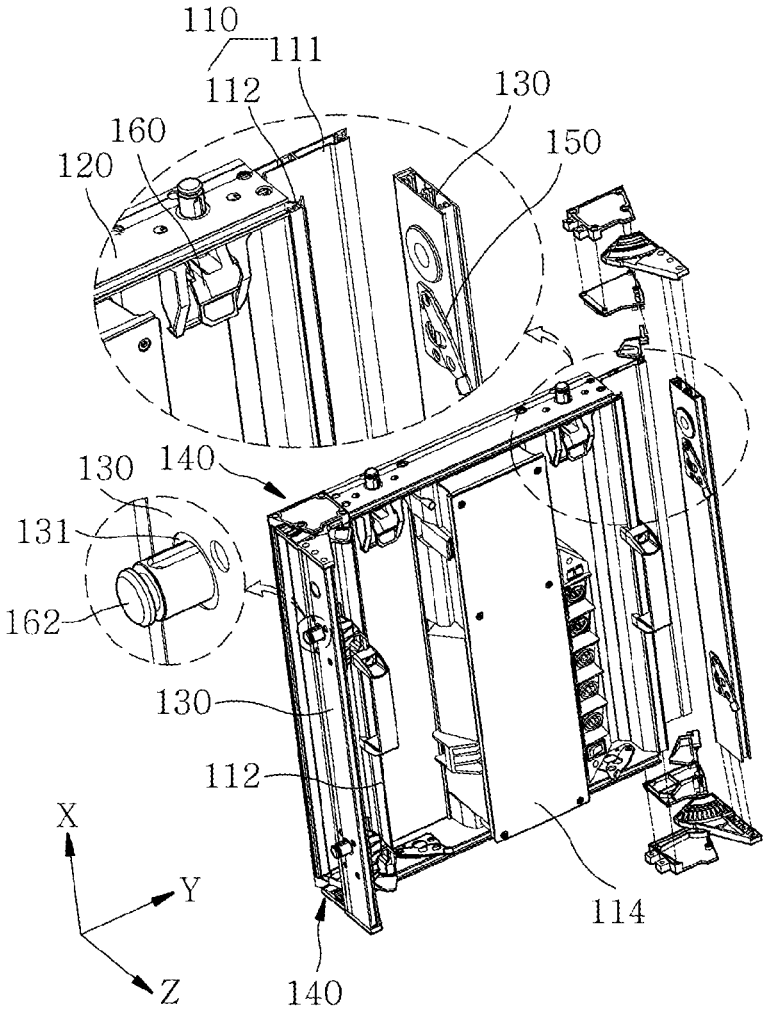
FIG. 3 is a perspective view showing the partial disassembly and assembly of the angle adjustment apparatus of an image display module shown in FIG. 1.
Figure 4:
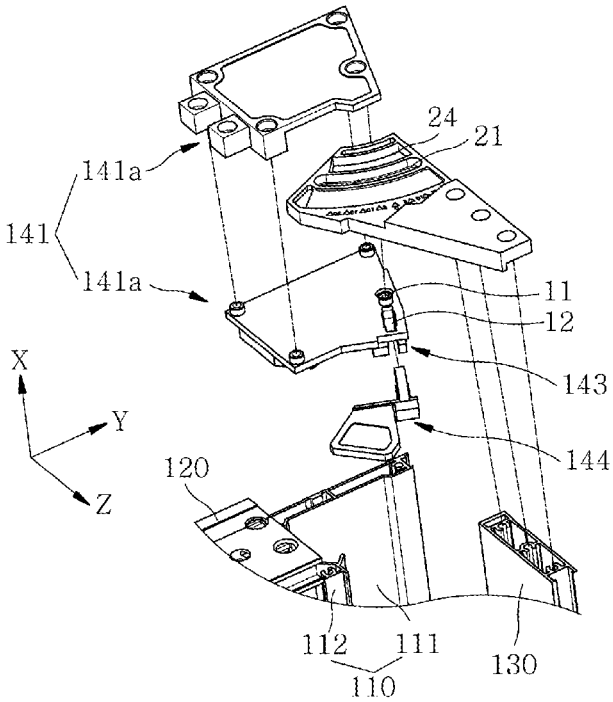
FIG. 4 is an enlarged perspective view of an angle adjustment unit disposed on the upper side of fixture and rotation frames shown in FIG. 3.
Figure 5:
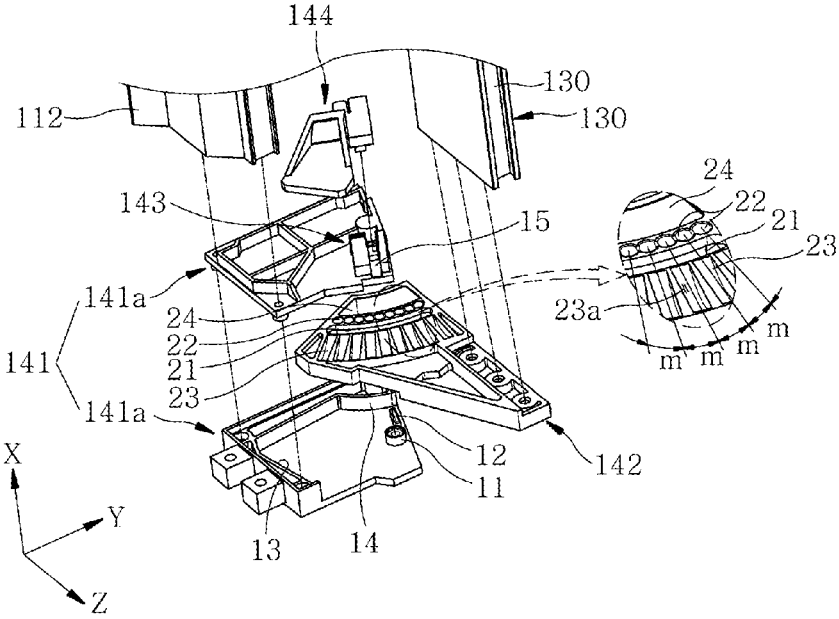
FIG. 5 is an enlarged perspective view of an angle adjustment unit disposed on the lower side of the fixture and rotation frames shown in FIG. 3.

As shown in FIGS. 1 to 3, the angle adjustment apparatus of an image display module according to the present invention includes a display panel 110, fixture frames 120, rotation frames 130, and step angle adjustment units 140.

Image display devices 113 (shown in FIG. 7) are arranged in the display panel 110, and the fixture frames 120 are disposed on the upper and lower sides of the display panel 110, respectively. The rotation frames 130 are disposed on one side and the other side of the display panel 110, respectively. Each of the step angle adjustment units 140 is disposed between the rotation frames 130 and the auxiliary frame 112 of the display panel 110 and is configured to adjust the angle of the rotation frames 130 by stepwise moving the rotation frames 130 at a constant angle when the rotation frames 130 are rotated.

The angle adjustment apparatus of an image display module constructed as above according to the present invention is described in detail below with reference to the accompanying drawings.

Figure 7:
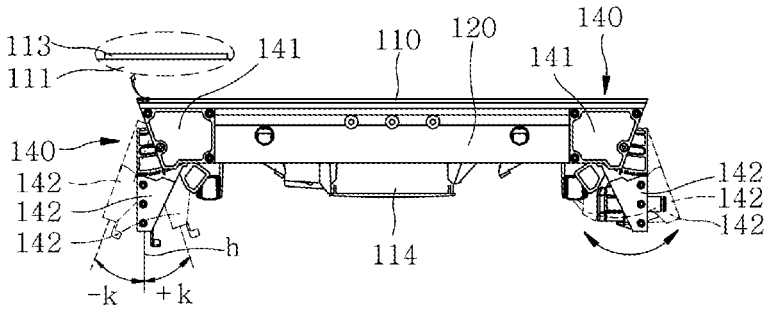
FIG. 7 is a diagram showing the operating state of the angle adjustment apparatus of an image display module shown in FIG. 1.

The display panel 110 includes a panel frame 111 and the auxiliary frames 112, as shown in FIGS. 3 and 7. The plurality of image display devices 113 is arranged in the front of the panel frame 111 in a matrix form, and the auxiliary frames 112 are disposed on one side and the other side of the panel frame 111, respectively. A power control box 114 is disposed between the auxiliary frames 112 of the panel frame 111. Light-Emitting Diodes (LEDs) are used as the respective image display devices 113.

The fixture frames 120 are disposed on the upper and lower sides of the display panel 110, respectively, as shown in FIGS. 1 and 3. That is, the fixture frames 120 are fixed to the panel frame 111 and the auxiliary frames 112 of the display panel 110 by fastening members (not shown), such as bolts or nuts. A pair of through holes 121 is disposed to face the fixture frame 120 so that the shaft 162 of a second engagement appliance 160 is guided and moved.

The rotation frames 130 are connected to the display panel 110 by the step angle adjustment units 140 in such as way as to be rotated, as shown in FIGS. 1 to 3. The rotation frames 130 are disposed on one side and the other side of the display panel 110, respectively. Furthermore, the rotation frames 130 are formed to face a pair of through holes 131 so that the shaft 162 of the second engagement appliance 160 is guided and moved. Furthermore, the rotation frames 130 are rotated by the step angle adjustment units 140 in a rotation angle −k~+k of −20 to +20 degrees on the basis of a position where the fixture frames 120 are orthogonal to the rotation frames 130, that is, on the basis of a reference line h shown in FIG. 7. The rotation frame 130 is stepwise moved and rotated at an interval of 2 to 8 degrees by the step angle adjustment units 140, so that an angle of the display panel 110 can be adjusted more safely.

The step angle adjustment units 140 have one sides connected to the display panel 110 and the fixture frames 120, respectively, so that one sides are placed at the respective edge parts of the display panel 110 and have the other sides are connected to the rotation frames 130. Each of the step angle adjustment units 140 includes a rotation guide member 141, a rotation block 142, a step support appliance 143, and a cam lever 144, as shown in FIGS. 2 to 6.

The rotation guide members 141 are disposed in the display panel 110 and the fixture frames 120, respectively. Rollers 11 are disposed in the rotation guide members 141. Each of the rotation guide member 141 includes a first rotation guide block 141*a* and a second rotation guide block 141*b*. The first rotation guide blocks 141*a* are disposed in the display panel 110 and the fixture frames 120, respectively. The roller 11 and a guide bar 12 are disposed on one side of the first rotation guide blocks 141*a* so that the roller 11 and the guide bar 12 are spaced apart from each other. A stopper 13 and a guide curved surface unit 14 are disposed on the other side of the first rotation guide blocks 141*a* and integrated therewith. The second rotation guide block 141*b* is installed in the first rotation guide block 141*a*, and a through hole 15 is formed on one side of the second rotation guide block 141*b*. The first rotation guide blocks 141*a* and the second rotation guide blocks 141*b* are fixed by fastening members (not shown), such as bolts or nuts.

The rotation block 142 is disposed in the rotation frame 130. Slots 21 inserted into the roller 11 are formed in the rotation block 42 so that the rotation block 142 is guided to the rotation guide member 141 and thus rotated. Furthermore, a plurality of step grooves 22 and a plurality of cam grooves 23 are formed in the rotation block 142 and are arranged at intervals of a specific angle m, that is, 2 to 8 degrees. The plurality of cam grooves 23 is arranged in an arc form, and a cam curved surface unit 23*a* is formed at the bottom of each of the cam grooves 23. The slot 21 inserted into the roller 11 is formed in an arc form. A guide groove 24 is formed on one side of the slots 21, and thus the guide bar 12 of the first rotation guide block 141*a* is inserted into the guide groove 24 and thus guided thereto. The guide groove 24 is formed in an arc form.

The step support appliance 143 is disposed on one side of the rotation guide member 141 and is supported by the plurality of step grooves 22 of the rotation block 142 so that the rotation blocks 142 are stepwise moved at an interval of a specific angle. The step support appliance 143 includes a step support body 143*a* and a ball plunger 143*b*. The step support body 143*a* is disposed on one side of the rotation guide member 141, that is, the second rotation guide block 141*b*, and the ball plunger 143*b* is disposed on the other side of the step support body 143*a* and supported by the plurality of step grooves 22 of the rotation block 142, so that the rotation block 142 is stepwise moved at an interval of a specific angle m, that is, 2 to 8 degree.

The cam lever 144 is connected to the step support appliance 143 and is fixed to or separated from the plurality of cam grooves 23 of the rotation block 142 so that the rotation block 142 is fixed or separated. The cam lever 144 includes an eccentric cam 144*a* and a lever 144*b*. The eccentric cam 144*a* is connected to the step support body 143*a* of the step support appliance 143 by a pin 25 and is fixed or separated by the cam grooves 23 of the rotation block 142. The lever 144*b* is extended up to the eccentric cam 144*a*. When the eccentric cam 144*a* is rotated, the cam lever 144 is supports the rotation block 142 and thus fixes the rotation frames 130.

The pair of first engagement appliances 150 and the pair of second engagement appliances 160 are disposed in the fixture frames 120 or the rotation frames 130, respectively, so that they are spaced apart from each other as shown in FIGS. 1 and 3 and are used to assemble the plurality of image display modules into one electric bulletin board or dismantle the plurality of image display modules into the respective image display modules.

Figure 6:
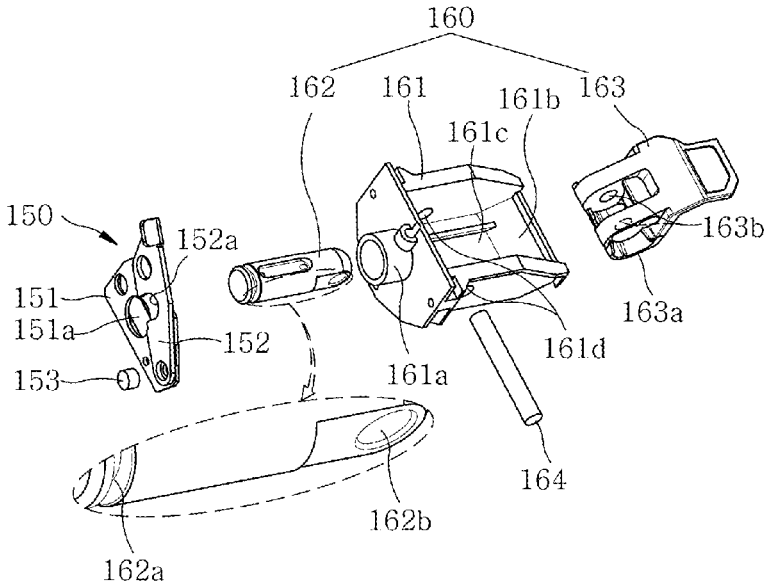
FIG. 6 is an exploded and enlarged perspective view of a module engagement appliance shown in FIG. 3.

The pair of first engagement appliances 150 includes a fixing plate 151 and a rotation plate 152, as shown in FIGS. 1 and 6. The fixing plate 151 is disposed in the fixture frame 120 or the rotation frame 130, and it has a through hole 151*a* formed at its center. The fixing plate 151 is disposed in the fixture frame 120 or the rotation frame 130 so that the through hole 151*a* is aligned in the through hole 121 formed in the fixture frames 120 or the through hole 131 formed in the rotation frames 130. The rotation plate 152 is disposed on one side of the fixing plate 151 in such a way as to be rotated by the pin 153. An engagement groove unit 152*a* having one side opened is formed in the rotation plate 152. The engagement groove unit 152*a* is brought in contact with an insertion groove 162*a* formed in a shaft 162, so that the shaft 162 is engaged with the rotation plate 152.

Each of the pair of second engagement appliances 160 includes a lever body 161, the shaft 162, and a cam lever 163. The lever body 161 is disposed in the fixture frame 120 or the rotation frame 130. A hollow member 161*a* is formed on one side of the lever body 161, and an installation space unit 161*c* having a slant unit 161*b* is formed at the center of the lever body 161.

The shaft 162 is disposed in such a way as to be guided and moved by the hollow member 161*a* of the lever body 161. An insertion groove 162*a* is formed on one side of the shaft 162 along a circumferential face thereof and is engaged with the engagement groove unit 152*a* of the rotation plate 152. A through hole 162*b* is formed on the other side of the shaft 162. The through hole 162*b* is inserted into a roller 163*b* installed in the cam lever 163.

The cam lever 163 is inserted into the installation space unit 161*c* of the lever body 161 and is connected to the other side of the shaft 162 by the roller 163*b*. The cam lever 163 includes a cam curved surface unit 163*a* so that the shaft 162 is moved when the cam lever 163 is guided and moved to the slant unit 161*b* by the lever body 161. The pair of rollers 163*b* is disposed on one side of the cam lever 163 so that it faces the cam lever 163. The pair of rollers 163*b* are connected to one side and the other side of the through holes 162*b* of the shaft 162, respectively.

The operation of the angle adjustment apparatus of an image display module constructed as above according to the present invention is described below.

The angle adjustment work of an image display module is performed to adjust the rotation frames 130 (see FIG. 3) in a range of −20 to +20 degrees around a reference line h as shown in FIG. 7. The step angle adjustment units 140 are used in order to adjust the rotation angle of the rotation frames 130 more safely.

The step angle adjustment unit 140 fixes the rotation block 142 to the rotation guide member 141 or dismantles the rotation block 142 from the rotation guide member 141 when the cam lever 144 is rotated. When the cam lever 144 is rotated, the eccentric cam 144*a* is brought in contact with or separated from the cam grooves 23 so that the rotation block 142 is fixed to or separated from the rotation guide member 141. The eccentric cam 144*a* adjusts the rotation angle of the rotation frames 130 in the state in which the rotation block 142 has not been fixed to the rotation guide member 141.

When the rotation angle of the rotation frames 130 is adjusted, the rotation frames 130 are stepwise rotated in order to prevent a safety accident occurring because the rotation frames 130 are excessively rotated. That is, in the state in which the rotation block 142 has been separated from the rotation guide member 141, the ball plunger 143*b* of the step support appliance 143 remains fixed to the step grooves 22.

The ball plungers 143*b* are supported to the step grooves 22 by elastic force, and thus the rotation frames 130 are fixed to the rotation guide member 141. When a worker rotates the rotation frames 130 in this state, the ball plunger 143*b* is moved to a next step groove 22 so that the rotation frames 130 are stepwise moved. Thus, the rotation angle of the rotation frames 130 can be precisely adjusted by moving the rotation frames 130 at a constant interval. A slot 21 into which the roller 11 is inserted or a guide groove 24 into which the guide bar 12 is inserted are formed in the rotation block 142 so that the rotation block 142 is rotated along the roller 11 and the guide bar 12 of the rotation guide member 141.

The pair of first engagement appliances 150 and the pair of second engagement appliances 160 are used in order to assemble or disassemble the image display modules in addition to the angle adjustment work of the image display module.

In order to assemble a plurality of image display modules into one electric bulletin board, first, the shaft 162 of the second engagement appliance 160 is inserted into the through hole 151*a* of the fixing plate 151 and the engagement groove unit 152*a* of the rotation plate 152 is then inserted into the insertion groove 162*a* formed in the shaft 162, thereby fixing the shaft 162 to the first engagement appliance 150.

After the shaft 162 is fixed, the image display modules are connected by manipulating the cam lever 163 of the second engagement appliance 160 so that the cam curved surface unit 163*a* is firmly supported to the slant unit 161*b* of the lever body 161. A disassemble work is performed in opposite order of the assembly work. A plurality of image display modules can be assembled into or disassembled from one electric bulletin board rapidly and easily by separating the image display module.

The angle adjustment apparatus of an image display module according to the present invention is advantageous in that it can reduce the time taken to install and dismantle image display modules because the angle adjustment work of an image display module is easy and that it can adjust the angle of the image display module precisely by moving the image display modules at a constant angle stepwise.

The angle adjustment apparatus of an image display module according to the present invention can be applied to all manufacture fields of the electric bulletin board.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An angle adjustment apparatus of an image display module, comprising:

a display panel configured to have the image display devices arranged and disposed therein;

fixture frames disposed on upper and lower sides of the display panel, respectively;

rotation frames disposed on one side and the other side of the display panel, respectively; and step angle adjustment units disposed between the display panel and the rotation frames and configured to adjust an angle of the rotation frames by stepwise moving the rotation frames at a constant angle when the rotation frames are rotated.

2. The angle adjustment apparatus of claim 1, wherein the rotation frames are rotated by the step angle adjustment units in a range of −20 to +20 degrees based on a position that is orthogonal to the fixture frames.

3. The angle adjustment apparatus of claim 1, wherein the rotation frames are stepwise moved and rotated by the step angle adjustment units at an angle of 2 to 8 degrees.

4. The angle adjustment apparatus of claim 1, wherein a pair of first engagement appliances or a pair of second engagement appliances is installed in the fixture frames or the rotation frames, respectively, so that the first engagement appliances or the second engagement appliances are spaced apart from each other.

5. The angle adjustment apparatus of claim 4, wherein each of the pair of first engagement appliances comprises:

a fixing plate disposed in the fixture frame or the rotation frame and configured to have a through hole formed at a center thereof; and a rotation plate disposed on one side of the fixing plate in such a way as to be rotated by a pin, wherein an engagement groove unit having one side opened is formed in the rotation plate.

6. The angle adjustment apparatus of claim 4, wherein each of the pair of second engagement appliances comprises:

a lever body installed in the fixture frame or the rotation frame and configured to have an installation space unit formed therein, wherein the installation space unit has a hollow member formed on one side thereof and a slant unit formed at a center thereof;

a shaft disposed in such a way as to be guided and moved by the hollow member of the lever body and configured to have an insertion groove formed on one side thereof along a circumferential face thereof, wherein the insertion groove is engaged with the engagement groove unit of the rotation plate; and a cam lever configured to comprise a cam curved surface unit, wherein the cam curved surface unit is inserted into the installation space unit of the lever body, connected to the other side of the shaft by a pin, and guided and rotated by the slant unit of the lever body so that the shaft is moved.

7. The angle adjustment apparatus of claim 1, wherein the step angle adjustment units have one sides connected to the fixture frame and the display panel, respectively, and have the other sides connected to the rotation frame.

8. The angle adjustment apparatus of claim 1, wherein the step angle adjustment unit comprise:

rotation guide members disposed in the display panel and the fixture frame, respectively, and configured to have a roller disposed therein;

a rotation block disposed in the rotation frame and configured to comprise slots inserted into the rollers so that the rotation block is guided and rotated by the rotation guide member and a plurality of step grooves and a plurality of cam grooves so that the step grooves and the cam grooves are arranged at intervals of a specific angle;

a step support appliance disposed in one side of the rotation guide member and supported to the plurality of step grooves of the rotation block so that the rotation block is stepwise moved at an interval of a specific angle; and a cam lever connected to the step support appliance and fixed to or separated from the plurality of cam grooves of the rotation block so that the rotation block is fixed to or separated from the cam lever.

9. The angle adjustment apparatus of claim 8, wherein the rotation guide member comprises:

first rotation guide blocks disposed in the display panel and the fixture frame, respectively, and configured to have a roller and a guide bar, spaced apart from each other, disposed on one side and to have a stopper and a guide curved surface unit integrally formed therewith; and a second rotation guide block disposed in the first rotation guide block and configured to have a through hole formed on one side thereof.

10. The angle adjustment apparatus of claim 8, wherein:

the plurality of cam grooves of the rotation block is arranged in an arc form, and cam curved surface units are formed at bottoms of the cam grooves, respectively.

11. The angle adjustment apparatus of claim 8, wherein:

each of the slots of the rotation block is formed in an arc form, a guide groove into which the guide bar of the first rotation guide block is inserted and by which the guide bar is guided is formed on one side of the slots, and the guide groove is formed in an arc form.

12. The angle adjustment apparatus of claim 8, wherein the step support appliance comprises:

a step support body disposed on one side of the rotation guide member; and a ball plunger disposed on the other side of the step support body and supported to the plurality of step grooves of the rotation block so that the rotation block is stepwise moved at an interval of a specific angle.

13. The angle adjustment apparatus of claim 8, wherein the cam lever comprises:

an eccentric cam connected to the step support body of the step support appliance by a pin and fixed or separated by the cam grooves of the rotation block; and a lever configured to turn the eccentric cam extended up to the eccentric cam.

* * * * *